United States Patent [19]

Gaylord

[11] 4,281,635

[45] Aug. 4, 1981

[54] KITCHEN VENTILATOR WITH INLET THROAT CHOKE ATTACHMENTS

[75] Inventor: Edson C. Gaylord, Wilsonville, Oreg.

[73] Assignee: Gaylord Industries, Inc., Wilsonville, Oreg.

[21] Appl. No.: 89,030

[22] Filed: Oct. 29, 1979

[51] Int. Cl.[3] ..... F24C 15/20

[52] U.S. Cl. ..... 126/299 D; 55/DIG. 36; 126/299 E

[58] Field of Search ..... 126/299 R, 299 D, 299 E; 98/115 R; 55/DIG. 36

[56] References Cited

U.S. PATENT DOCUMENTS

| | | | |
|---|---|---|---|
| 2,392,038 | 1/1946 | Gaylord | 126/299 D |
| 3,207,058 | 9/1965 | Gaylord | 55/DIG. 36 |
| 3,805,685 | 4/1974 | Carns | 126/299 E |
| 4,072,143 | 2/1978 | Gaylord | 126/299 D |

*Primary Examiner*—Albert J. Makay
*Assistant Examiner*—Harold Joyce
*Attorney, Agent, or Firm*—Lee R. Schermerhorn

[57] ABSTRACT

Choke attachments are applied to that portion of the inlet of the ventilator serving low pollution cooking units in a row of various types of cooking units in a restaurant kitchen. This reduces the rate of air removal from the kitchen, and in most cases also the rate of air removal from an adjoining dining room, to conserve energy without impairing the efficiency of the ventilator.

4 Claims, 4 Drawing Figures

KITCHEN VENTILATOR WITH INLET THROAT CHOKE ATTACHMENTS

BACKGROUND OF THE INVENTION

This invention relates to a kitchen ventilator for removing air laden with grease, smoke, fumes and moisture rising from various types of cooking units.

In a restaurant kitchen, for example, there are usually a number of cooking units lined up side by side in a row. Some of these cooking units such as broilers and fryers produce considerable quantities of smoke, fumes, grease particles and moisture while other units such as ranges and griddles generate such pollutants in considerably less amounts. Kitchen ventilators have heretofore been designed with sufficient air flow capacity to remove the smoke, fumes, grease and moisture from the most active of the pollution generating cooking units such as the broilers and fryers. This results in excess and unnecessary ventilation for those cooking units generating less pollution such as the ranges and the griddles.

Such excess ventilation is wasteful of energy in two ways. First, an excessive flow of air must be handled by the exhaust fan, thus requiring a larger fan motor which consumes more electrical energy than necessary. Second, the excess air withdrawn from the kitchen is replaced, at least in part, by air from the dining room and other parts of the restaurant. In cold weather this produces a heat loss in the dining room and other parts of the restaurant which must be compensated by the central heating system. In hot weather an excess of cool air is withdrawn from the dining room, increasing the load on the air conditioning system and again requiring additional electric power to maintain a comfortable temperature in the dining room.

Objects of the present invention are therefore to provide a kitchen ventilator which does not remove an excessive volume of air from the atmosphere over cooking units which do not generate large quantities of smoke, fumes, grease particles and moisture, to provide a kitchen ventilator having supplemental inlet throat choke means to reduce the airflow over such cooking units and to provide such choke means as attachments to be applied to appropriate parts of the ventilator without reducing the airflow to other parts of the ventilator which must be capable of exhausting large quantities of such pollutants.

SUMMARY OF THE INVENTION

In the present construction supplemental inlet throat choke attachments are provided to reduce or throttle the flow of air through portions of the ventilator where the maximum available rate of air removal is not required to remove the pollutants generated by the associated cooking units. One such attachments is mounted on the outer face of a damper baffle which is hinged to the upper boundary of the inlet throat opening of the ventilator. This attachment protrudes toward the front edge of a grease trough which forms the lower boundary of the inlet throat opening whereby the width of the inlet opening is reduced by the protrusion of the attachment.

In open position the damper baffle is inclined downward and rearward toward a back wall of the ventilator. A second attachment on the back wall protrudes forward toward the lower edge of the damper baffle in open position to form a second throat choke or throttle where the incoming air enters the grease extractor portion of the ventilator. A third attachment is applied to extend an upper baffle in the grease extractor.

In the usual installation one or more such damper baffles are associated with a common grease trough in the manner described to form an inlet throat opening extending above a row of the various cooking units. The inlet throat choke attachments are applied only in the region of those cooking units which produce a relatively small volume of smoke, fumes, grease, and moisture to restrict the airflow in this portion of the ventilator. By the use of such attachments the main parts of the ventilator may be of uniform standarized construction and the cost of manufacture and installation is not increased by reason of the different airflow characteristics of different parts of the ventilator. A single ventilator is made to function as two separate ventilators having different characteristics.

The invention will be better understood and the foregoing and other objects and advantages will become apparent from the following description of the preferred embodiment illustrated in the accompanying drawings. Various modifications may be made in the construction and arrangement of parts and certain features may be used without others. All such modifications within the scope of the appended claims are included in the invention.

DESCRIPTION OF THE PREFERRED EMBODIMENT

Figure 1:
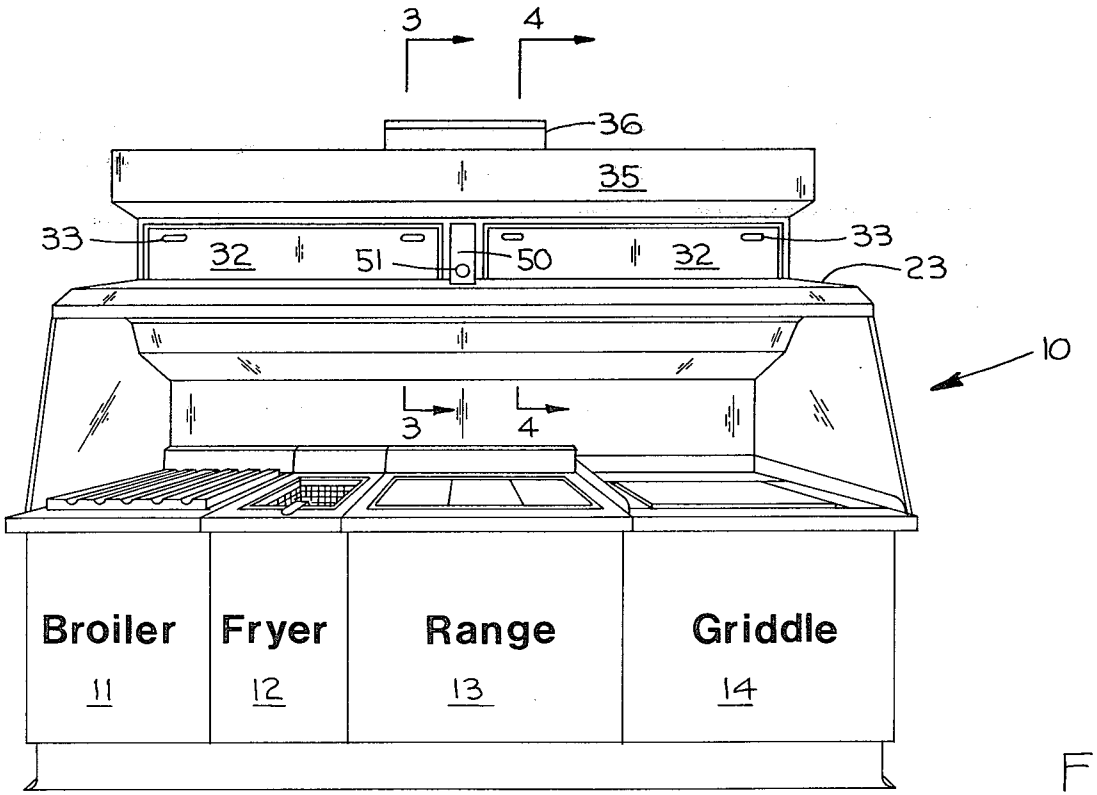
FIG. 1 is a front view of a kitchen ventilator embodying the invention.

Referring first to FIG. 1, the present kitchen ventilator 10 is mounted over a row of typical cooking units some of which generate large quantities of smoke, fumes, grease particles and moisture and others of which generate much less of such pollutants and may be referred to as less contaminating. The more polluting units such as broiler 11 and fryer 12 are positioned at one end of the row and the less polluting units such a range 13 and griddle 14 are positioned at the other end of the row. This row of cooking units may be backed up against a wall of the kitchen or they may be placed in an island arrangement at a distance from any wall.

The purpose of ventilator 10 is to capture the smoke, fumes, grease and moisture generated by the cooking units and remove these pollutants from the kitchen to maintain a comfortable working atmosphere in the kitchen and also to prevent the dispersal of such pollutants into the dining room and other parts of the restaurant. In order to remove the pollutants a considerable quantity of air must be removed from the kitchen.

Heretofore the air removal capability of such ventilators has been uniform along of the length of the row of cooking units. In order to provide sufficient air removal capability or capacity with a single ventilator over the high pollution units such as the broiler and fryer a considerable excess of air was removed over the low polluting units such as the range and griddle. As previously pointed out this was wasteful of energy both from the standpoint of excess capacity in the ventilator itself and from the standpoint of the extra heating or cooling required in the dining room and other parts of the restaurant to compensate for the air removed by the kitchen ventilator.

In the present ventilator greater economy is achieved by reducing or eliminating excess air removal from the kitchen over the low polluting range and griddle units. The particular advantage of the present form of construction is that this desirable result is accomplished by the mere addition of simple attachments to one section of the ventilator without sacrificing economy of construction obtained by a single ventilator unit which is uniform in design and dimensions over the whole length of the row of cooking units. The attachments convert a single ventilator into the equivalent of two separate and different ventilators.

A damper baffle 30 is mounted on a horizontal pivot 31 at the upper boundary of inlet throat opening 22. Extending upward from damper baffle 30 the front wall of the ventilator comprises removable panels 32 having handle latching means 33. Air entering inlet opening 22 is drawn upward through a grease extractor between panels 32 and backwall 24 into a suction chamber 35 from whence it is removed by an exhaust duct 36 containing an exhaust fan and fire damper (not shown).

The grease extractor comprises upper and lower horizontal baffles 40 and 41 projecting forward from backwall 24 and a baffle 42 projecting rearward from each of the two front panels 32 at a level between backwall baffles 40 and 41. Baffles 40 and 41 are equipped with cleaning and fire extinguishing nozzles 43 supplied by water or steam pipes 44 incorporated in the baffles.

Figure 3:
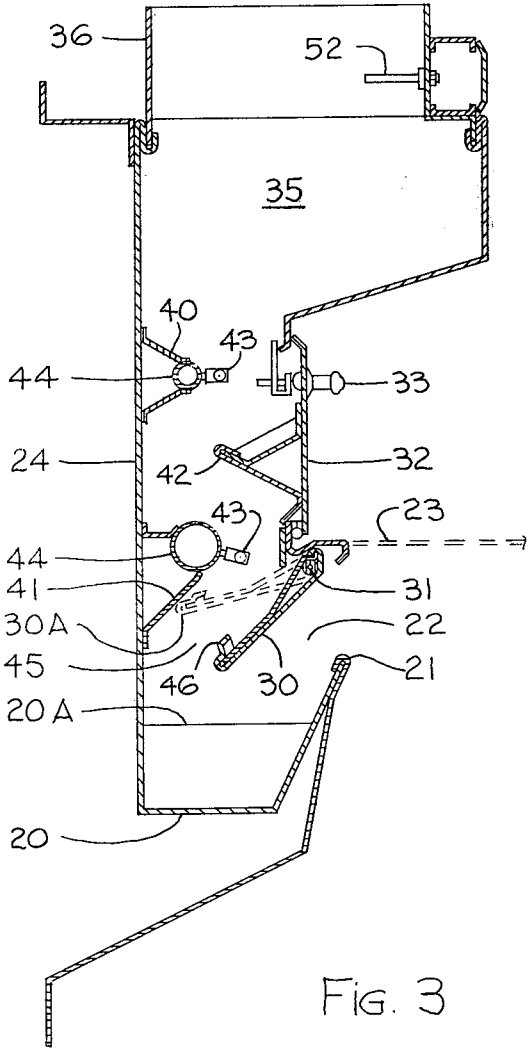
FIG. 3 is a view on the line 3—3 in FIG. 1.

Damper baffle 30 is also a grease extracting baffle in its open position shown in solid lines in FIG. 3. In open position the damper baffle 30 projects downward and rearward beneath baffle 41 to form a second throat opening at 45 of approximately the same width as inlet throat opening 22. This baffle arrangement produces sharp reversals in the direction of flow of the grease laden airstream to extract grease particles by centrifugal force at each reversal of direction of flow. A flange 46 on the lower edge of damper baffle 30 provides a grease gutter to convey extracted grease to one end of the damper baffle so that it will not drip through the rising airstream at random points and be recaptured by the air stream. Flange 46 terminates just short of the ends of the damper baffle to provide drain openings out of the main flow of the air stream.

Figure 2:
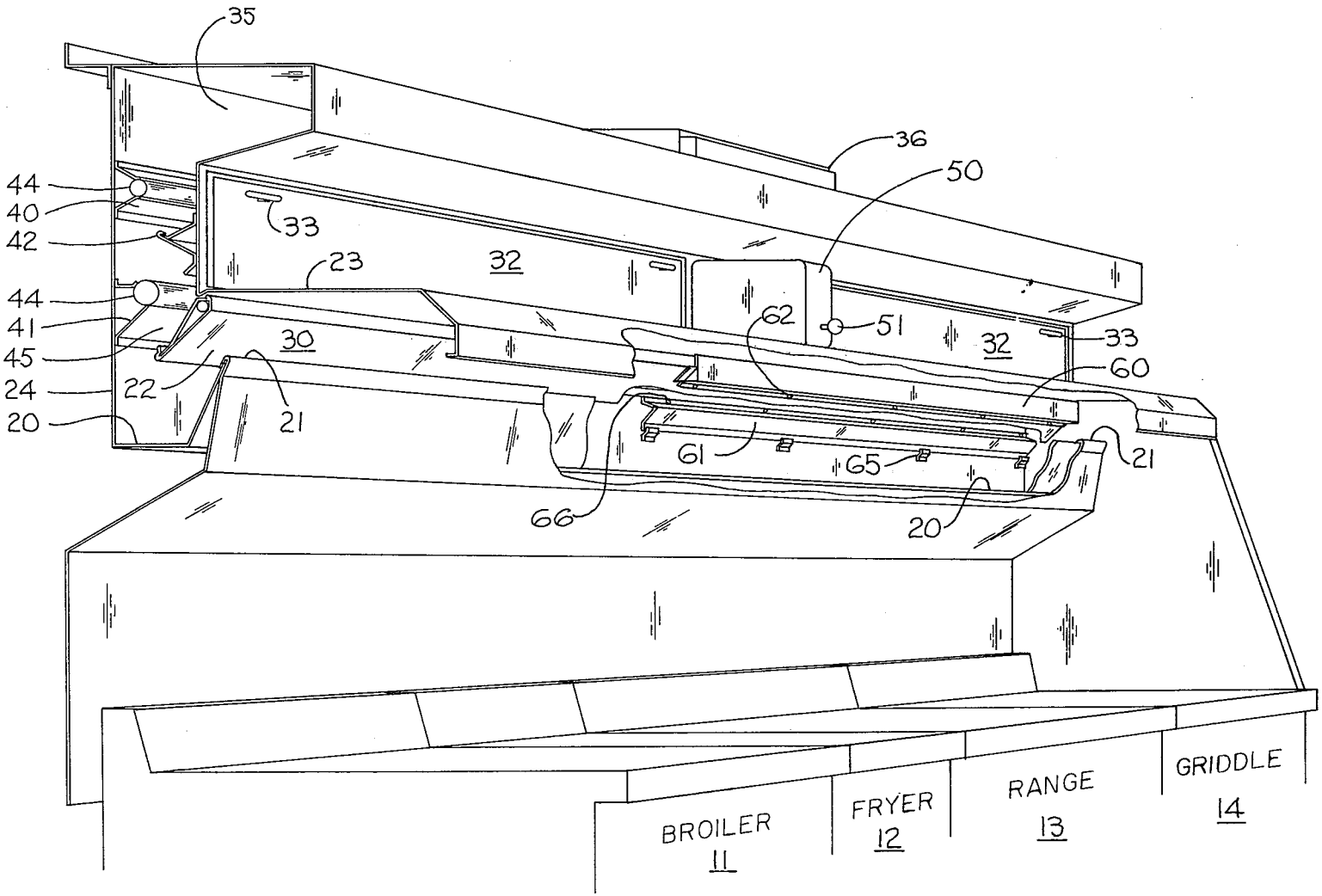
FIG. 2 is a perspective view with parts broken away.

Damper baffle 30 pivots to a closed position shown in broken lines at 30A engaging the underside of baffle 41 to close the throat opening 45. Damper baffle 30 is closed automatically in case of fire by the control mechanism 50 in FIGS. 1 and 2 which has a manual reset knob 51 for opening the damper baffle. The automatic closing in response to fire is actuated by thermostats 52 in FIGS. 3 and 4 as explained in the Gaylord U.S. Pat. No. 3,055,285. Control mechanism 50 also causes fire quenching steam or water to be discharged from nozzles 43. Such control mechanism may also include means for using nozzles 43 in washing cycles to wash grease from the grease extracting baffles.

Figure 4:
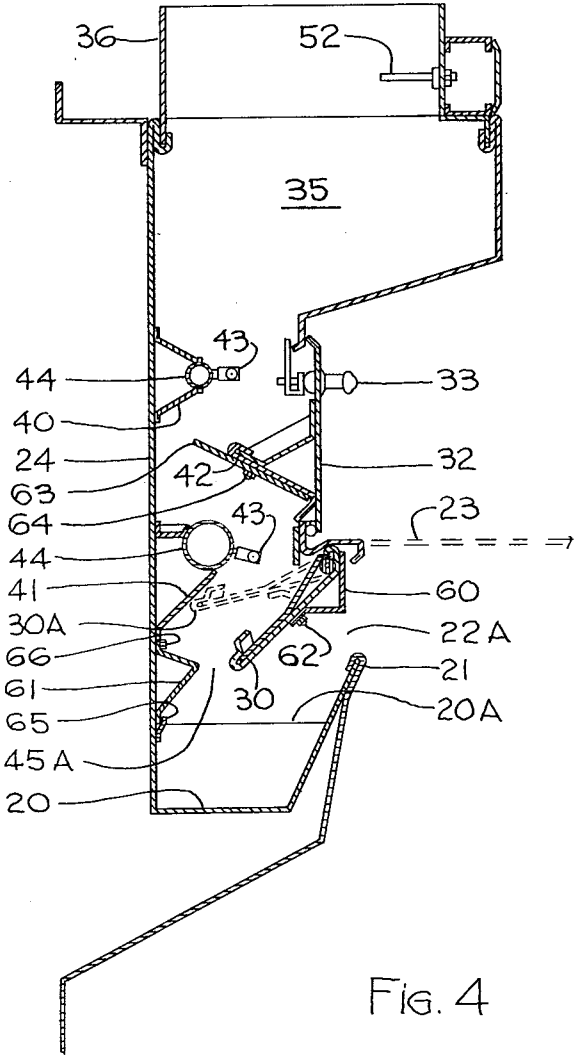
FIG. 4 is a view on the line 4—4 in FIG. 1.

Grease trough 20, inlet opening 22 and damper baffle 30 extend the entire length of the ventilator over all of the cooking units 11–14. FIG. 4 illustrates two attachments 60 and 61 which are applied to reduce the rate of air flow into the ventilator over the less polluting range and griddle units 13 and 14. Attachment 60 is an elongated angle plate of L-shape in cross section mounted on the upper portion of the front face of damper baffle 30 to protrude toward front edge 21 of grease trough 20 and reduce the width of the inlet opening as indicated at 22A. Attachment 60 thus acts as a throttle or choke in the inlet throat opening.

The lower edge of angle plate 60 is attached to the damper baffle by screws 62 and the upper edge is attached by spot welds or other suitable means. Attachment 60 is readily removable by removing screws 62 and burning off the spot welds.

Attachment 61 is an L-shaped angle plate which projects forward from back wall 24 toward the lower edge of damper baffle 30 in open position to reduce the width of the opening at this point as indicated at 45A in FIG. 4. Thus the attachment 61 acts as a second throttle or choke restricting the inlet flow into the ventilator. The lower edge of angle plate 61 is supported by upstanding lips 65 on back wall 24 and the upper edge is attached by screws 66. This attachment is removable by merely removing the screws 66.

A third flat plate attachment 63 is secured to baffle 42 by screws 64 to extend this baffle closer to backwall 24 and maintain adequate air velocity in the sharp turn of the upward flowing air stream around this baffle for effective centrifugal grease extraction.

It is found in practice that the angle plates or chokes 60 and 61 do not change the velocity of the air in the inlet opening 22A whereby this velocity remains adequate to withdraw the contaminated air over the range 13 and griddle 14 without allowing such air to escape into the kitchen. In other words the velocity of flow through openings 22A and 45A in FIG. 4 is the same as the velocity through openings 22 and 45 in FIG. 3.

As shown in FIG. 4 the angle plate chokes 60 and 61 and flat plate choke 63 reduce the width of the respective openings at these points by approximately one half whereby the volume of air withdrawn from the kitchen per minute over the range and griddle units 13 and 14 is only one half that withdrawn from the kitchen over the broiler and fryer units 11 and 12, per linear foot of inlet opening. This materially reduces the load on the exhaust fan of the ventilator and correspondingly reduces the load on the dining room heating or cooling sysem which must replace the heated or cooled air removed by the kitchen ventilator.

At the same time the attachments 61 and 63 maintain undimished velocity at these two points of sharp reversal in the direction of air flow so that the reduction in volume of air does not reduce the effectiveness of the grease extractor.

The invention is not limited to the particular volume ratio expressed above; this is determined by the polluting effects of the low pollution cooking units in relation to the polluting effects of the high pollution cooking units in a particular installation.

The attachments 60, 61 and 63 are fabricated in strips of indefinie length and then cut to a length corresponding to the combined width of the low polluting cooking units 13 and 14. As shown, these attachments are associated with the same damper baffle 30, and corresponding baffle 42, that extend over the higher pollution cooking units 11 and 12. In kitchens having a longer row of cooking units there may be more than one damper baffle 30 and more than two baffles 42 and in such case the length of attachments 60, 61 and 63 is made to correspond to the combined width of the low polluting cooking units regardless of the number of damper baffles 30 and baffles 42 involved.

If the kitchen is rearranged to put the high polluting cooking units on the right and low polluting cooking units on the left in FIG. 1, the present attachments are readily adaptable to such change by merely removing them from the right end of the ventilator and attaching them to the left end.

What is claimed is:

1. In a kitchen venilator having a baffle type grease extractor with an elongated inlet throat opening of uniform width extending above a row of cooking units wherein some of said cooking units produce less air pollution than other of said units and wherein said width of said throat opening is determined by the spacing of a damper baffle of uniform width above the front edge of a grease trough which forms the lower boundary of said throat opening, said ventilator having a back wall behind said damper baffle and grease trough and said damper baffle in open position being inclined downward and rearward from the upper boundary of said throat opening toward said back wall beneath a grease extracting baffle of uniform width projecting forward from said back wall, and said ventilator having an upper grease extracting baffle projecting rearward toward said back wall from said front wall above said damper baffle and back wall baffle; the improvement comprising a pair of supplemental and removable throat choke attachments for reducing the air flow over said less polluting cooking units, a first of said supplemental throat choke attachments comprising an elongated L-shaped angle plate extending along the front face of a portion of said damper baffle which is above said less polluting cooking units, said attachment protruding outward from said front face of the damper baffle toward said front edge of said grease trough to reduce the width of said throat opening along said portion of the damper baffle, and the second of said supplemental throat choke attachments comprising an elongated L-shaped angle plate protruding forward below said back wall baffle toward the lower edge of said portion of said damper baffle in said open position.

2. The invention of claim 1, said first angle plate having upper and lower side edges secured to said damper baffle.

3. The invention of claim 1, said last angle plate having a lower side edge supported on an upstanding lip on said backwall and having an upper side edge secured to said backwall.

4. The invention of claim 1 including an attachment on said upper baffle extending closer to said back wall.

* * * * *